US006571207B1

(12) United States Patent
Kim

(10) Patent No.: US 6,571,207 B1
(45) Date of Patent: May 27, 2003

(54) DEVICE FOR PROCESSING PHASE INFORMATION OF ACOUSTIC SIGNAL AND METHOD THEREOF

(75) Inventor: Doh-suk Kim, Yongin (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/571,417

(22) Filed: May 15, 2000

(30) Foreign Application Priority Data

May 15, 1999 (KR) ..... 1999-17505

(51) Int. Cl.[7] ..... G10L 21/00

(52) U.S. Cl. ..... 704/200; 704/200.1; 704/205

(58) Field of Search ..... 704/200, 201, 704/203, 205, 207, 209, 200.1, 220, 221, 224

(56) References Cited

U.S. PATENT DOCUMENTS

| | | | | |
|---|---|---|---|---|
| 5,303,346 A | | 4/1994 | Fesseler et al. | |
| 5,381,512 A | * | 1/1995 | Holton et al. | 704/200.1 |
| 5,388,181 A | | 2/1995 | Anderson | |
| 5,581,653 A | * | 12/1996 | Todd | 704/206 |
| 5,583,962 A | * | 12/1996 | Davis et al. | 704/200.1 |
| 5,632,005 A | * | 5/1997 | Davis et al. | 381/22 |
| 5,727,119 A | | 3/1998 | Davidson et al. | |

OTHER PUBLICATIONS

John W. Goedon; System Architectures for Computer Music; Computing Serveys, vol. 17, No. 2, pp. 191–233, Jun. 1985.*

Doh–Suk Kim, "Perceptual Phase Redundancy In Speech", 2000 IEEE International Conference On Acoustics, Speech, and Signal Processing. Proceedings (CAT. No. 00CH37100), Istanbul, Turkey, 5–9, Jun. 2000, pp. 1383–1386 vol. 3.

H. Pobloth et al. "On Phase Perception In Speech", Phoenix, AZ, Mar. 15–19, 1999, New York, NY: IEEE, US, Mar. 15, 1999, pp. 29–32.

(List continued on next page.)

*Primary Examiner*—Tālivaldis Ivars Šmits
*Assistant Examiner*—Abul K. Azad
(74) *Attorney, Agent, or Firm*—Burns, Doane, Swecker & Mathis, L.L.P.

(57) ABSTRACT

A device for processing the phase information of an acoustic signal, and a method thereof are provided. This device processes the phase information of a digital speech signal which is expressed as a discrete sum of periodic signals having different frequency components. Also, this device includes a critical bandwidth calculator for calculating the critical bandwidth of each frequency according to the bandwidth characteristics of a human's auditory filter, a frequency range setting unit for setting the frequency ranges of local phase changes using critical bandwidths corrected by multiplying the critical bandwidths by a predetermined scaling coefficient, and a phase significance discriminator for checking whether frequency components adjacent to each frequency are within the frequency range corresponding to the frequency, and discriminating whether the phase of a signal having the frequency component is significant in terms of auditory characteristics. Accordingly, phase components which are significant for auditory perception can be discriminated among the phase components of an acoustic signal. Also, when the device and method of processing the phase information of an acoustic signal are applied to speech coding, only phase components significant upon auditory perception can be selectively coded among the components of an acoustic signal. Thus, a good quality of sound can be obtained as compared to a method in which the phase information of an acoustic signal is not coded, and the amount of information can be reduced as compared to a method of coding all phase information.

12 Claims, 7 Drawing Sheets

OTHER PUBLICATIONS

Changxue Ma et al., "A Perceptual Study of Source Coding of Fourier Phase and Amplitude of the Linear Predictive Coding Residual of Vowel Sounds", Journal of the Acoustical Society of America, US, American Institute of Physics. New York, vol. 95 No. 4, Apr. 4, 1994, pp. 2231–2239.

Zwicker, E., and H. Fastl, "Psychoacoustics: Facts and Models," Springer–Verlag, 2$^{nd}$ Eds., 1999.

Moore, Brian C.J., "An Introduction to the Psychology of Hearing," Academic Press, 4$^{th}$ Eds., 1997.

Patterson, R.D., "A Pulse Ribbon Model of Monaural Phase Perception," J. Acoust. Soc. Am, vol. 82, No. 5, pp. 1560–1586, 1987.

Schroeder, M. R., "New Results Concerning Monaural Phase Sensitivity," J. Acoust. Soc. Am, vol. 31, p. 1579, 1959.

MacAulary, R.J. and T.F. Quatieri, "Sinusoidal Coding in Speech Coding and Synthesis," W.B. Klein and K.K. Palivwal Eds., Elsevier, pp. 121–173, 1998.

Marques, J.S. and L.B. Almeida, "Sinusoidal Modeling of Voiced and Unvoiced Speech," European Conference on Speech Communication and Technology, vol. 2, Paris, 1989, pp. 203–206.

Marques, J.S. and L.B. Almeida and J.M. Tribolet, "Harmonic Coding at 4.8kb/s," in Proc. ICASSP, pp. 17–20, 1990.

* cited by examiner

DEVICE FOR PROCESSING PHASE INFORMATION OF ACOUSTIC SIGNAL AND METHOD THEREOF

BACKGROUND OF THE INVENTION

1. Field of the Invention

The present invention relates to a device for processing the phase information of an acoustic signal and a method thereof, and more particularly, to a device for processing the phase information of an acoustic signal, by which important phase components are discriminated in consideration of human auditory recognition characteristics, and a method thereof.

2. Description of the Related Art

Research into auditory psychophysics due to a change in the phase of an acoustic signal is in progress, but useful results have not yet been obtained in large numbers. The research results into auditory psychophysics due to a change in the phase of acoustic signals are disclosed by E. Zwicker and H. Fastl, ["Psychoacoustics-Facts and Models", Springer-Verlag, $2^{nd}$ Eds, 1999], and B. C. J. Moore, ["Introduction to the Psychology of Hearing", Academic Press, $4^{th}$ Eds., 1997]. According to these documents, the cochlea of the internal ear among hearing organs can be modeled as a filter bank. The filter bank includes band pass filters, and the passband of each filter can be estimated when the central frequency of the filter is given. Signal processing within a human ear has been known as multi-channel signal processing preformed in units of each critical band of the filter.

When a phase change in a signal is considered from this standpoint, a local phase change denotes a change in the relative phase relationship between signal components which exist within the same critical band (i.e., within the same channel). A global phase change denotes that the phase relationship between channels varies while the relative phase relationship between signal components within the same critical band is being kept. The human ear is dull to global phase changes and somewhat sensitive to local phase changes, which is not completely theorized but known in relation to auditory psychophysics with respect to phase. This is disclosed by R. D. Patterson, ["A Pulse Ribbon Model of Monaural Phase Perception", J. Acoust. Soc. Am., Vol. 82, No. 5, pp. 1560–1586,1987]; and M. R. Schroeder, ["New Results Concerning Monaural Phase Sensitivity", J.Acoust. Soc. Am, Vol. 31, p.1579, 1959].

Also, phase information processing in a harmonic speech system is disclosed by R. J. MacAulary and T. F. Quatieri, "Sinusoidal Coding in Speech Coding and Synthesis", W. B. Kleijn and K. K. Palivwal Eds, Elsevier, pp. 121–173, 1998; J. S. Marques and L. B. Almeida, "Sinusoidal Modeling of Voiced and Unvoiced Speech", in Proc. ICASSP, pp. 203–206, 1983; and J. S. Marques, L. B. Almeida, and J. M. Tribolet, "Harmonic coding at 4.8 kb/s", in Proc. ICASSP, pp. 17–20, 1990. According to these documents, a harmonic speech coding system can be used to express the excitation signal of speech using the following Equation 1:

$$e(n) = \sum_{k=1}^{K} A_k \cos(k\omega_0 n + \theta_k) \tag{1}$$

wherein $\omega_0$ denotes a fundamental frequency, $A_k$ denotes the spectral magnitude of harmonics, and $\theta_k$ denotes the phase of harmonics. The excitation signal is used as the input to a filter which has been modeled by the spectral envelope of speech, to thereby finally obtain an acoustic signal. Thus, in a speech coding system, spectrum envelope filter coefficients, the spectral magnitude $A_k$, the fundamental frequency $\omega_0$, and the phase of harmonics ($\theta_k$) are quantized and transmitted, and acoustic signals are synthesized using the received parameters. In present harmonic speech coding systems, the spectrum phase information $\theta_k$ is relatively neglected compared to the spectral magnitude information $A_k$ of a signal, and a method in which a transmission system does not send the phase information of an acoustic signal, but a reception system applies an arbitrary phase using the condition that the phase of an acoustic signal continuously changes, is generally used.

However, an acoustic signal synthesized by the conventional method does not provide a satisfactory quality of sound. Also, when phase information is completely coded to solve this problem, the amount of information increases too much.

SUMMARY OF THE INVENTION

An objective of the present invention is to provide an acoustic signal phase information processing device, in which important phase components are discriminated in consideration of human auditory characteristics to selectively code or synthesize the phase components of an acoustic signal.

Another objective of the present invention is to provide an acoustic signal phase information processing method performed by the above device.

To achieve the first objective, there is provided a device for processing the phase information of a digital speech signal which is expressed as a discrete sum of periodic signals having different frequency components, according to an aspect of the present invention. This device includes: a critical bandwidth calculator for calculating the critical bandwidth of each frequency according to the bandwidth characteristics of a human's auditory filter; a frequency range setting unit for setting the frequency ranges of local phase changes using critical bandwidths corrected by multiplying the critical bandwidths by a predetermined scaling coefficient; and a phase significance discriminator for checking whether frequency components adjacent to each frequency are within the frequency range corresponding to the frequency, and discriminating whether the phase of a signal having the frequency component is significant in terms of auditory characteristics.

Preferably, the device further includes an acoustic signal transformer for transforming an acoustic signal into the discrete sum of periodic signals having different frequency components. Also, it is preferable that the scaling coefficient is smaller than 1. Preferably, the phase significance discriminator obtains an assembly of frequencies having phases that are significant in terms of auditory characteristics.

To achieve the first objective, a device for processing the phase components of an acoustic signal, according to another aspect of the present invention, includes: an acoustic signal transformer for transforming an acoustic signal into $$s(n) = \sum_{l=1}^{L} A_l \cos(\omega_l n + \theta_l),$$

wherein L is an integer greater than 1, $A_1$, $\omega_l$, and $\theta_l$ denote the spectral magnitude, frequency, and phase of an I-th periodic signal, respectively, and $\omega_1 < \omega_2 < \ldots < \omega_L$; a critical bandwidth calculator for calculating the critical bandwidth of each frequency according to the bandwidth characteristics of a human's auditory filter; a frequency range setting unit for obtaining critical bandwidths $\omega_{L,UB}$ and $\omega_{l,LB}$ corrected by multiplying the critical bandwidths by a predetermined scaling coefficient, and setting a frequency set of a channel satisfying the condition of $\omega_{l,LB} \leqq \omega \leqq \omega_l$ with the frequency $\omega_l$ set as an upper bound, to be $C(\omega_l,1)$, and setting a frequency set of a channel satisfying the condition of $\omega_l \leqq \omega \leqq_{I,UB}$ with the frequency $\omega_I$ set as a lower bound, to be $C(\omega_l,2)$; and a phase significance discriminator for discriminating whether the conditions of $\omega_{I-1} \notin C(\omega_l,1)$ and $\omega_{l+1} \notin C(\omega_l,2)$ are satisfied with respect to $\omega_l$, and outputting significance data representing that the phase $\theta_I$ of the frequency $\omega_l$ is not significant in terms of auditory characteristics, if the conditions are satisfied, and otherwise, outputting significance data representing that the phase $\theta_I$ of the frequency $\omega_l$ is significant in terms of auditory characteristics.

To achieve the second objective, a method of processing the phase components of an acoustic signal, according to an aspect of the present invention includes: (a) expressing an acoustic signal as a discrete sum of periodic signals having different frequency components; (b) calculating the critical bandwidth of each frequency according to the bandwidth characteristics of a human's auditory filter; (c) obtaining corrected critical bandwidths by multiplying the critical bandwidths by a predetermined scaling coefficient; (d) setting the frequency ranges of local phase changes using the critical bandwidths corrected in step (c); and (e) checking whether frequency components adjacent to each frequency are within the frequency range corresponding to the frequency, and discriminating whether the phase of a signal having the frequency component is significant in terms of auditory characteristics.

To achieve the second objective, a method of processing the phase components of an acoustic signal, according to another aspect of the present invention, includes: (a) expressing an acoustic signal as $$s(n) = \sum_{l=1}^{L} A_l \cos(\omega_l n + \theta_l),$$

wherein L is an integer greater than 1, $A_I$, $\omega_l$, and $\theta_I$ denote the spectral magnitude, frequency, and phase of an I-th periodic signal, respectively, and $\omega_l < \ldots < \omega_L$; (b) calculating the critical bandwidth of each frequency according to the bandwidth characteristics of a human's auditory filter; (c) obtaining critical bandwidths $\omega_{l,UB}$ and $\omega_{l,LB}$ corrected by multiplying the critical bandwidths by a predetermined scaling coefficient; (d) setting the frequency $\omega_l$ as an upper bound and setting a frequency set of a channel satisfying the condition of $\omega_{l,LB} \leqq \omega \leqq \omega_l$ to be $C(\omega_l,1)$; (e) setting the frequency $\omega_l$ as a lower bound and setting the frequency assembly of a channel satisfying the condition of $\omega_l \leqq \omega \leqq \omega_{l,UB}$, to be $C(\omega_l,2)$; and (e−1) determining the phase $\theta_1$ of the frequency $\omega_l$ as a phase which is not significant in terms of auditory characteristics, if the conditions are satisfied in step (e); and (e−2) determining the phase $\omega_l$ the frequency ωI as a phase which is significant in terms of auditory characteristics, if the conditions are not satisfied in step (e); (f) determining whether I is L, and concluding the process if the I is L, and otherwise, increasing the I by one and returning to the step (e).

BRIEF DESCRIPTION OF THE DRAWINGS

The above objective and advantage of the present invention will become more apparent by describing in detail preferred embodiments thereof with reference to the attached drawings in which.

DESCRIPTION OF THE PREFERRED EMBODIMENTS

Figure 1:
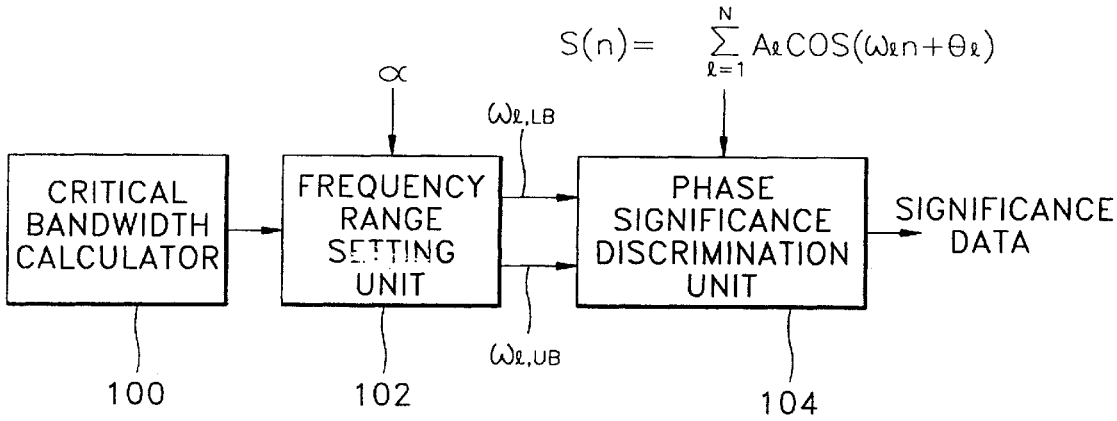
FIG. 1 is a block diagram illustrating the structure of a device for processing the phase information of an acoustic signal, according to an embodiment of the present invention.
Figure 2:
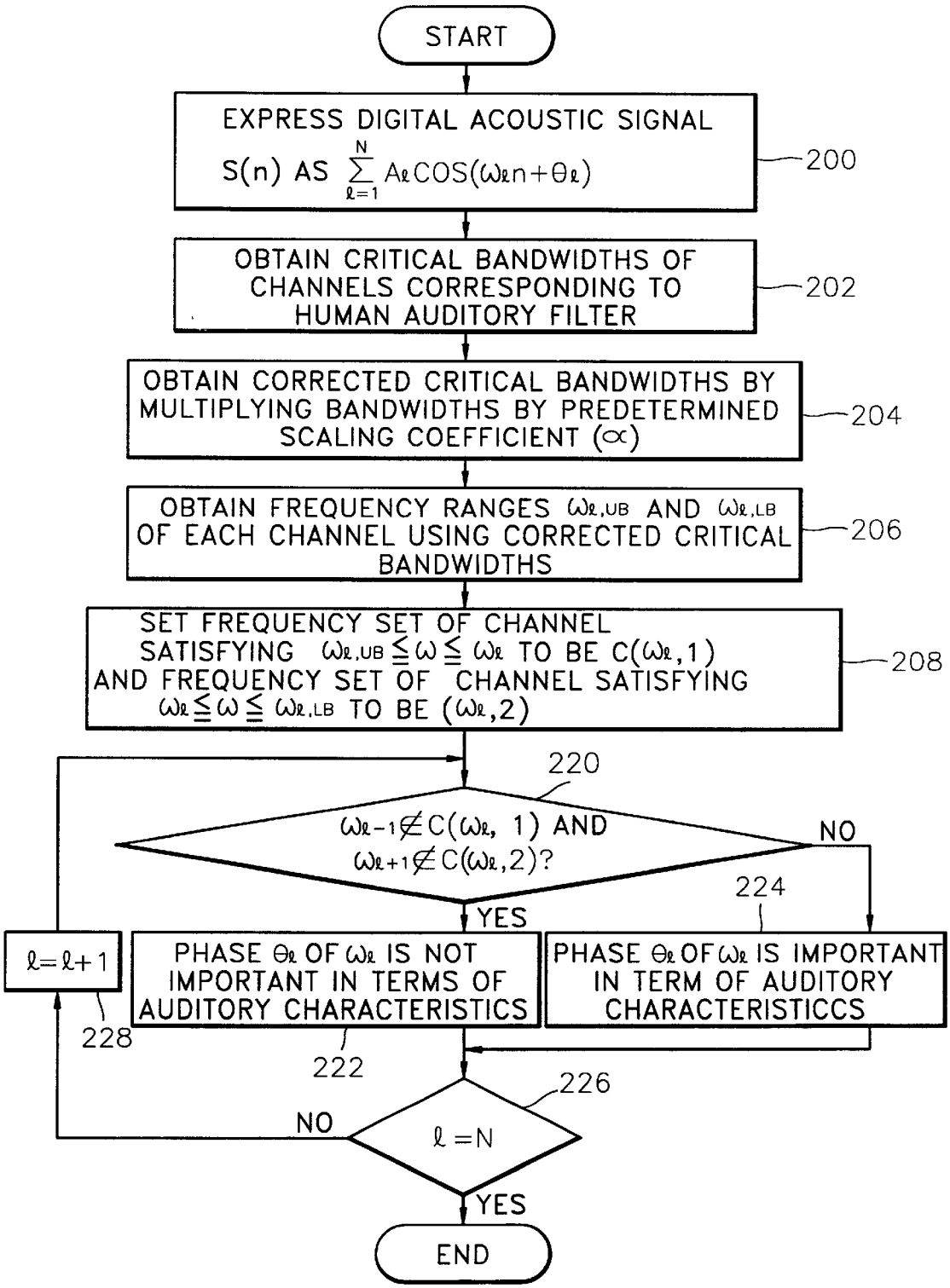
FIG. 2 is a flowchart illustrating a method of processing the phase information of an acoustic signal, according to an embodiment of the present invention.

Referring to FIGS. 1 and 2, a device for processing the phase information of an acoustic signal according to the present invention includes a critical bandwidth calculator 100, a frequency range setting unit 102, and a phase significance discrimination unit 104.

In the operation of the device, first, it is assumed that a digital signal to be synthesized can be expressed as in the following Equation 2:

$$s(n) = \sum_{l=1}^{L} A_l \cos(\omega_l n + \theta_l) \tag{2}$$

wherein L is an integer greater than 1, $A_l$ denotes the amplitude of an I-th periodic signal, $\omega_I$ denotes the frequency thereof, $\theta_I$ denotes the phase thereof, and $\omega_l < \omega_2 < \ldots < \omega_L$, in step 200. The digital signal is expressed as a line spectrum in each $\omega_l$ in the frequency domain. A transformer (not shown) for transforming an acoustic signal into the discrete sum of periodic signals having different frequencies, may be further included as necessary.

The critical bandwidth calculator 100 calculates the critical bandwidths of channels corresponding to a human's auditory filter according to the bandwidth characteristics of the human's auditory filter, in step 202. For example, an equivalent rectangular bandwidth (ERB) or a bark scale can be applied as the bandwidth characteristics of the human's auditory filter.

The frequency range setting unit 102 obtains corrected critical bandwidths by multiplying the critical bandwidths by a predetermined scaling coefficient (α), in step 204. The frequency range setting unit 102 also sets the frequency ranges ωI,UBand $\omega_{l,LB}$ of a local phase change using the corrected critical bandwidths, in step 206. In the present embodiment, it is assumed that the scaling coefficient (α) is 1, and the frequency ranges $\omega_{l,UB}$ and $\omega_{l,LB}$ are the same as the corrected critical bandwidths. It is preferable that the scaling coefficient (α) can be controlled by auditory experiments, and is smaller than 1. Also, the frequency ranges $\omega_{l,UB}$ and $\omega_{l,LB}$ can also be controlled to some extent by the auditory experiments.

The frequency range setting unit 102 also sets a frequency set of a channel satisfying the condition of $\omega_{l,LB} \leqq \omega \leqq \omega_l$, wherein the frequency $\omega_l$ is set as an upper bound, to be $C(\omega_l,1)$ and sets a frequency set of a channel satisfying the condition of $\omega_l \leqq \omega \leqq \omega_{l,UB}$, wherein the frequency $\omega_l$ is set as a lower bound, to be $C(\omega_l,2)$, in step 208.

In step 220, the phase significance discrimination unit 104 discriminates whether ωIsatisfies the conditions shown in the following Inequality 3:

$$\omega_{l-1} \notin C(\omega_l,1) \text{ and } \omega_{l-1} \notin C(\omega_l,2) \quad (3)$$

That is, the phase significance discrimination unit 104 determines the phase $\theta_I$ of the frequency $\omega_l$ as a phase that is not significant in terms of auditory characteristics, if the conditions shown in Inequality 3 are satisfied, in step 222. Otherwise, the phase significance discrimination unit 104 determines the phase $\theta_I$ of the frequency $\omega_l$, as a phase that is significant in terms of auditory characteristics, in step 224. That is, the phase $\theta_I$ of the frequency $\omega_l$ satisfying the conditions shown in Inequality 3 is determined as a phase which is not significant in terms of auditory characteristics. Thus, the phase significance discrimination unit 104 discriminates whether the conditions of $\omega_{I-1} \notin C(\omega_l,1)$ and $\omega_{l-1} \notin C(\omega_l,2)$ are satisfied with respect to $\omega_l$. If the conditions shown in Inequality 3 are satisfied, the phase significance discrimination unit 104 outputs phase significance data representing that the phase $\theta_I$ of the frequency $\omega_l$ is not significant in terms of auditory characteristics, and otherwise, it outputs phase significance data representing that the phase $\theta_I$ of the frequency $\omega_l$ is significant in terms of auditory characteristics.

Also, the phase significance discrimination unit 104 checks if a parameter I has reached N, in step 226. If the parameter I has reached N, the discrimination process is concluded. Otherwise, the parameter I is increased by 1, and then the steps 220, 222 and 224 are repeated. Therefore, discrimination with respect to the phase of each frequency component is performed.

Figure 3A:
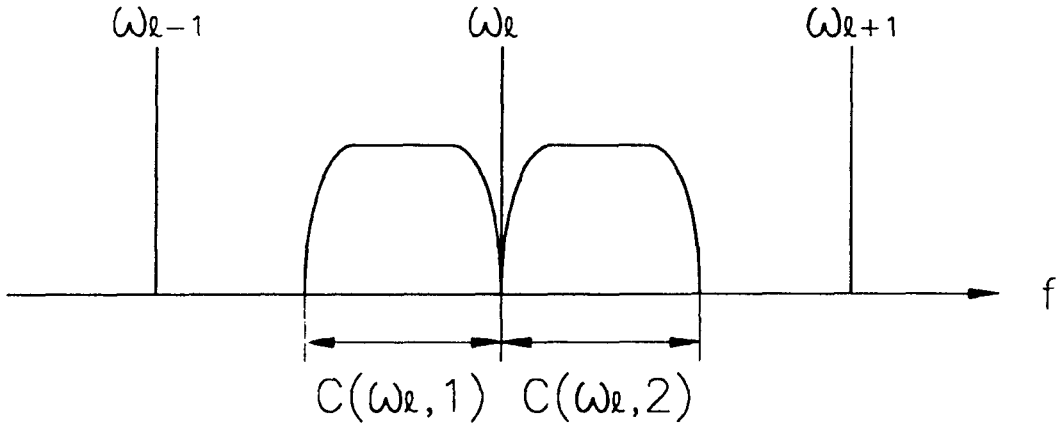
FIGS. 3A and 3B are views for illustrating a process for discriminating the phase importance in the device according to the present invention.
Figure 3B:
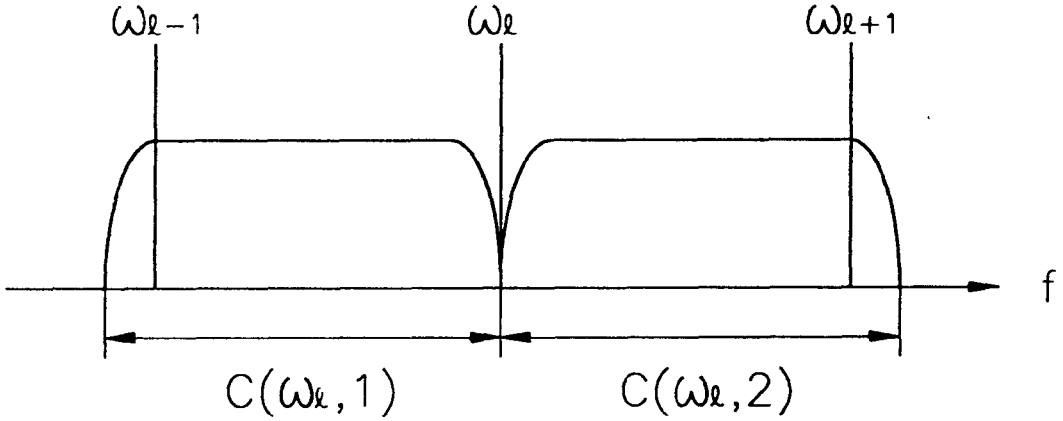

FIGS. 3A and 3B are views for explaining a process for discriminating the phase significance, wherein FIG. 3A refers to when Inequality 3 is satisfied and FIG. 3B refers to when Inequality 3 is not satisfied.

Referring to FIG. 3A,$\omega_l$ satisfies the conditions of $\omega_{l-1} \notin C(\omega_l,1)$ and $\omega_{l+1} \notin C(\omega_1,2)$ As described above, when $\omega_l$ satisfies the conditions shown in Inequality 3, only the frequency component of the frequency $\omega_l$ lies within a channel. Thus, even if the phase $\theta_I$ is synthesized or coded with an arbitrary phase value, the relative phase relationship within a channel is maintained, and does not affect other channels. Consequently, even if a signal having a different phase to the phase of the original signal is applied, it is very difficult to audibly perceive the difference.

Referring to FIG. 3B, $\omega_l$ satisfies the conditions of $\omega_{I-1} \epsilon C(\omega_l,1)$ and $\omega_{l+1} \epsilon C(w_1,2)$, so the conditions shown in Inequality 3 are not satisfied. As described above, when $\omega_l$ does not satisfy the conditions shown in Inequality 3, other frequency components mix within a channel. A phase change in this frequency causes a change in the relative phase relationship. Thus, a phase change greater than or equal to a certain amount can be audibly perceived. Consequently, if a corresponding frequency is synthesized with an arbitrary phase, a difference can be audibly perceived.

Figure 4:
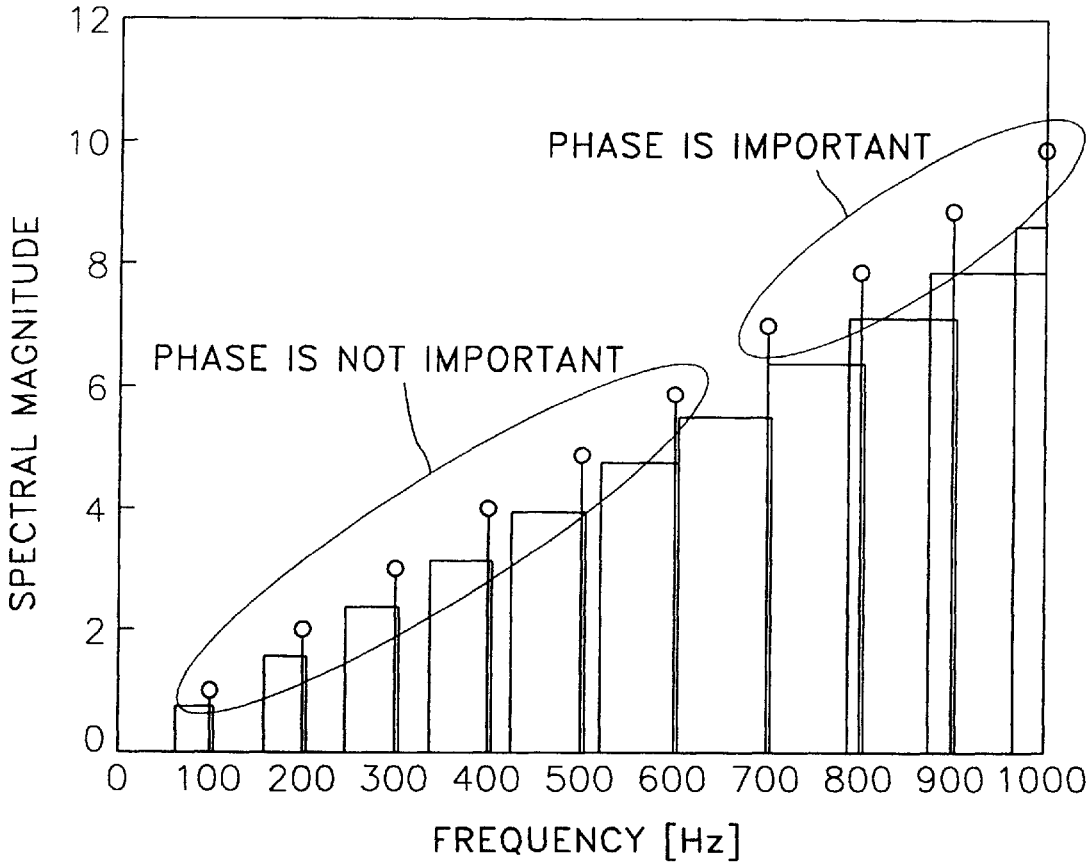
FIG. 4 is a graph showing a process for discriminating the phase importance with respect to a harmonic signal in the device according to the present invention.

FIG. 4 is graph showing a process for discriminating the phase significance with respect to a harmonic signal in the device according to the present invention. In FIG. 4, the horizontal axis represents the frequency of a harmonic signal in Hz, and the vertical axis represents the amplitude of the harmonic signal.

Generally, in view of human auditory characteristics, the critical bandwidth becomes wider as the frequency increases. Thus, a frequency component corresponding to a frequency of 100 Hz to 600 Hz is not included within two different critical bandwidths. Thus, the phase of this frequency is not important in terms of human auditory characteristics as described above with reference to FIG. 3A. On the other hand, a frequency component corresponding to a frequency of 700 Hz to 1000 Hz can be included within two different critical bandwidths. Thus, a phase change in this frequency can be perceived by the human ear as described above with reference to FIG. 3B.

This device and method for processing the phase information of an acoustic signal can be applied to speech coding. That is, upon coding, only phase components which are significant in terms of auditory characteristics are coded or synthesized. Upon decoding, even if uncoded phase components, that is, phase components that are not significant in terms of auditory characteristics, are synthesized by applying an arbitrary value, the difference can hardly be audibly perceived because of the human auditory characteristics. Therefore, phase components are transmitted or synthesized by applying the device and method for processing the phase information of an acoustic signal according to the present invention, so that the quality of sound can be improved. Also, the amount of phase information required can be reduced.

Figure 5:
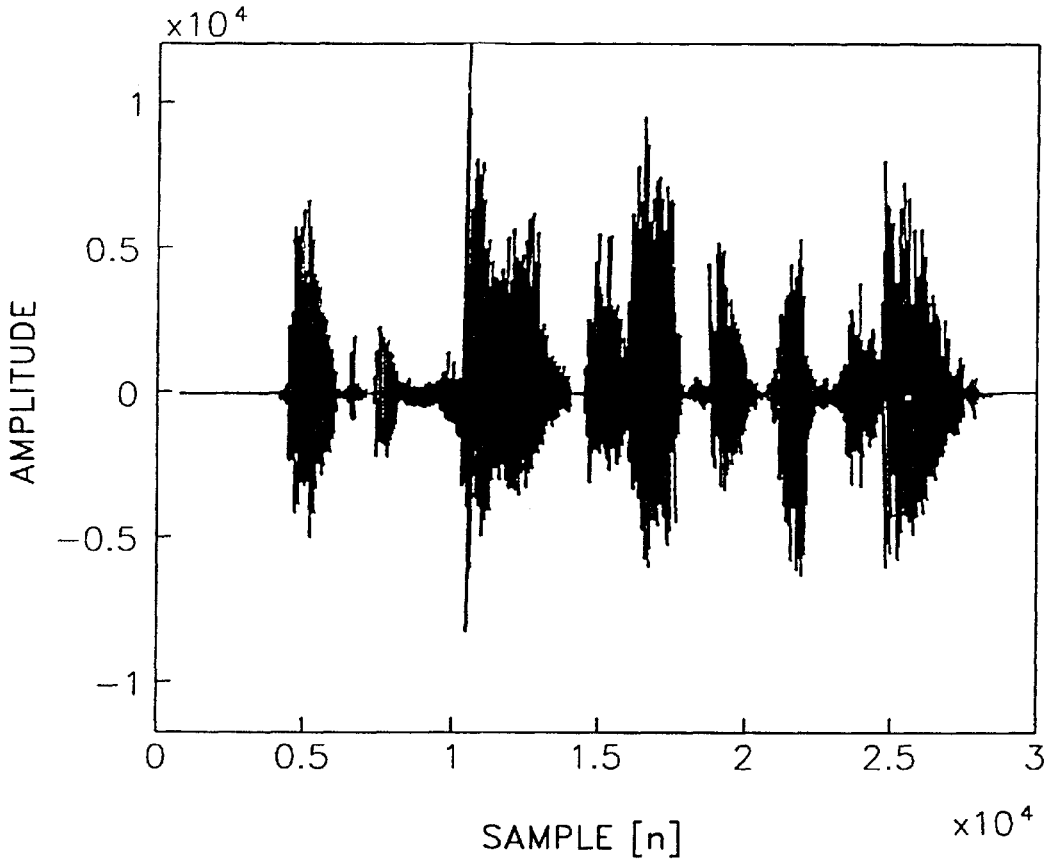
FIG. 5 is a waveform diagram illustrating the acoustic waveforms of a woman's speech in an NTT Advanced Technology Corporation (NATC: registered trademark) database.
Figure 6:
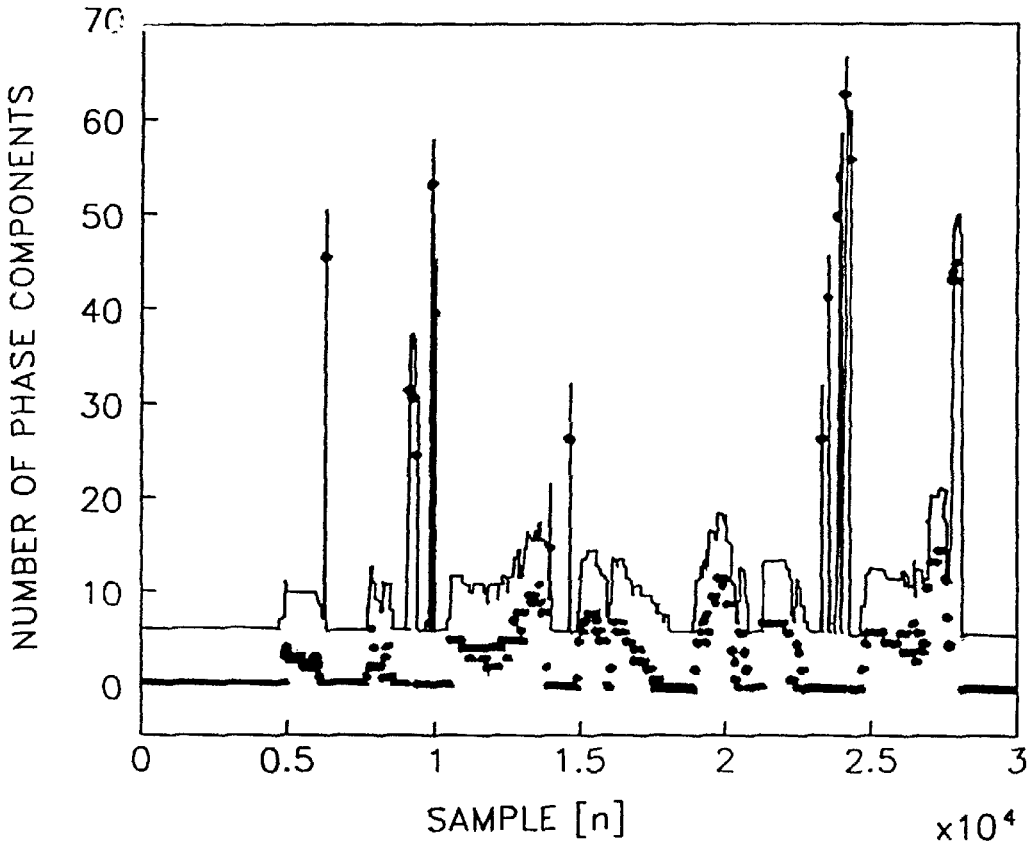
FIGS. 6 and 7 are graphs for explaining a reduction in phase transmission amount with respect to the speech of FIG. 5.
Figure 7:
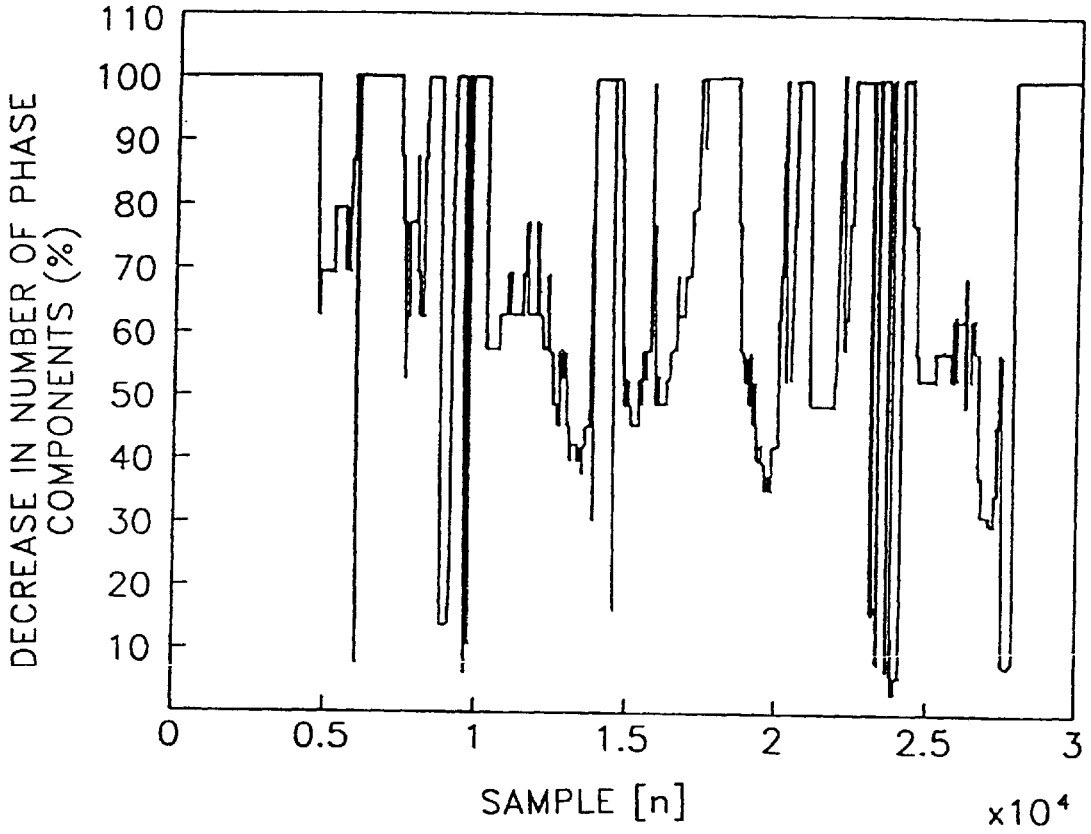

FIG. 5 is a waveform diagram illustrating the acoustic waveform of a woman's speech in an NTT Advanced Technology Corporation (NATC: registered trademark) database. FIG. 6 shows a comparison of the number of phase components to be transmitted when a method according to the present invention is applied to the speech of FIG. 5 and when a conventional method is applied to the speech of FIG. 5, according to the lapse of time. Referring to FIG. 6, when the conventional method is applied, the number of phase components to be transmitted according to the lapse of time is indicated by an unbroken line. When the method of the present invention is applied, frequency components, which are included one by one in an auditory channel, exist in a predetermined range of a low frequency, and may not be transmitted. Thus, the number of phase components to be transmitted is reduced. The number of phase components to be transmitted according to the present invention is indicated by a dotted line. Non-transmitted phase components are arbitrarily synthesized on the basis of consecutive phase change conditions. Here, as the results of an ERB experiment, there is no difference in auditory perception between speech synthesized using the phase components indicated by the unbroken line which transmitted through an auditory channel, and speech synthesized using only the phase components indicated by a dotted line which are transmitted therethrough. FIG. 7 shows percent decrease in the number of phase components by applying the present invention.

As described above, in the device and method of processing the phase information of an acoustic signal according to the present invention, significant phase components in terms of auditory perception can be discriminated among the components of an acoustic signal.

Also, when the device and method of processing the phase information of an acoustic signal according to the present invention are applied to speech coding, only the significant phase components in terms of auditory perception are selectively coded among the components of an acoustic signal. Thus, a good quality of sound can be obtained as compared to a method in which the phase information of an acoustic signal is not coded, and the amount of information can be reduced as compared to a method of coding all phase information. Also, it will be understood by one of ordinary skill in the art that these effects can be equally obtained from the fields of speech synthesis and speech transmission.

What is claimed is:

1. A device for processing the phase information of a digital speech signal which is expressed as a discrete sum of periodic signals having different frequency components, comprising:

a critical bandwidth calculator for calculating the critical bandwidth of each frequency according to the bandwidth characteristics of a human's auditory filter;

a frequency range setting unit for setting the frequency ranges of local phase changes using critical bandwidths corrected by multiplying the critical bandwidths by a predetermined scaling coefficient; and a phase significance discriminator for checking whether frequency components adjacent to each frequency are within the frequency range corresponding to the frequency, and discriminating whether the phase of a signal having the frequency component is significant in terms of auditory characteristics.

2. The device of claim 1, further comprising an acoustic signal transformer for transforming an acoustic signal into the discrete sum of periodic signals having different frequency components.

3. The device of claim 1, wherein the scaling coefficient is smaller than 1.

4. The device of claim 1, wherein the phase significance discriminator obtains an assembly of frequencies having phases that are significant in terms of auditory characteristics.

5. The device of claim 1, wherein the frequency range setting unit sets the frequency ranges of a channel, and the phase significance discriminator checks whether the frequency components adjacent to each frequency are within the frequency range of the channel corresponding to the frequency.

6. A device for processing the phase components of an acoustic signal, comprising:

an acoustic signal transformer for transforming an acoustic signal into $$s(n) = \sum_{l=1}^{L} A_l \cos(\omega_l n + \theta_l),$$

wherein L is an integer greater than 1, $A_1$, $\omega_l$, and $\theta_l$ denote the spectral magnitude, frequency, and phase of an I-th periodic signal, respectively, and $w_1<\omega_2< \ldots <\omega_L$;

a critical bandwidth calculator for calculating the critical bandwidth of each frequency according to the bandwidth characteristics of a human's auditory filter;

a frequency range setting unit for obtaining critical bandwidths $\omega_{L,UB}$ and $\omega_{l,LB}$ corrected by multiplying the critical bandwidths by a predetermined scaling coefficient, and setting a frequency set of a channel satisfying the condition of $\omega_{l,LB} \leqq \omega \leqq \omega_l$ with the frequency $\omega_l$ set as an upper bound, to be $C(\omega_l,1)$, and setting a frequency set of a channel satisfying the condition of $\omega_l \leqq \omega \leqq \omega_{l,UB}$ with the frequency $\omega_l$ set as a lower bound, to be $C(\omega_l,2)$; and a phase significance discriminator for discriminating whether the conditions of $\omega_{l-1} \notin C(\omega_l,1)$ and $\omega_{l+1} \notin C(\omega_l,2)$ are satisfied with respect to $\omega_l$, and outputting significance data representing that the phase $\theta_l$ of the frequency $\omega_l$ is not significant in terms of auditory characteristics, if the conditions are satisfied, and otherwise, outputting significance data representing that the phase $\theta_l$ of the frequency $\omega_l$ is significant in terms of auditory characteristics.

7. A method of processing the phase components of an acoustic signal, comprising:

(a) expressing an acoustic signal as a discrete sum of periodic signals having different frequency components;

(b) calculating the critical bandwidth of each frequency according to the bandwidth characteristics of a human's auditory filter;

(c) obtaining corrected critical bandwidths by multiplying the critical bandwidths by a predetermined scaling coefficient;

(d) setting the frequency ranges of local phase changes using the critical bandwidths corrected in step (c); and (e) checking whether frequency components adjacent to each frequency are within the frequency range corresponding to the frequency, and discriminating whether the phase of a signal having the frequency component is significant in terms of auditory characteristics.

8. The method of claim 7, wherein the scaling coefficient is smaller than 1.

9. The method of claim 7, wherein the frequency ranges are set for a channel, and it is checked whether the frequency components adjacent to each frequency are within the frequency range of the channel.

10. The method of claim 7 further comprising:

coding the phase of the signal having the frequency component if the phase is significant in terms of auditory characteristics.

11. The method of claim 10 further comprising:

transmitting the coded phase.

12. A method of processing the phase components of an acoustic signal, comprising:

(a) expressing an acoustic signal as $$s(n) = \sum_{l=1}^{L} A_l \cos(\omega_l n + \theta_l),$$

wherein L is an integer greater than 1, $A_l$, $\omega_l$, and $\theta_l$ denote the spectral magnitude, frequency, and phase of an I-th periodic signal, respectively, and $\omega_l<\omega_2< \ldots <\omega_L$;

(b) calculating the critical bandwidth of each frequency according to the bandwidth characteristics of a human's auditory filter;

(c) obtaining critical bandwidths $\omega_{l,UB}$ and $\omega_{l,LB}$ corrected by multiplying the critical bandwidths by a predetermined scaling coefficient;

(d) setting the frequency $\omega_l$ as an upper bound and setting a frequency set of a channel satisfying the condition of $\omega_{l,LB} \leqq \omega \leqq \omega_l$ to be $C(\omega_l,1)$;

(e) setting the frequency $\omega_l$ as a lower bound and setting the frequency assembly of a channel satisfying the condition of $\omega_I \leqq \omega \leqq \omega_{l,UB}$, to be $C(\omega_l,2)$; and (e−1) determining the phase $\theta_I$ of the frequency $\omega_l$ as a phase which is not significant in terms of auditory characteristics, if the conditions are satisfied in step (e); and (e−2) determining the phase $\theta_I$ of the frequency $\omega_l$ as a phase which is significant in terms of auditory characteristics, if the conditions are not satisfied in step (e);

(f) determining whether I is L, and concluding the process if the I is L, and otherwise, increasing the I by one and returning to the step (e).

* * * * *